United States Patent [19]

Bullard

[11] Patent Number: 4,815,381

[45] Date of Patent: Mar. 28, 1989

[54] MULTIPLE PULSE INERTIAL ARM/DISARM SWITCH

[75] Inventor: Douglas G. Bullard, Ogden, Utah

[73] Assignee: Morton Thiokol, Inc., Chicago, Ill.

[21] Appl. No.: 197,071

[22] Filed: May 20, 1988

[51] Int. Cl.[4] ..... F42C 15/00; F42C 15/40

[52] U.S. Cl. ..... 102/247; 102/248; 102/262

[58] Field of Search ..... 102/262, 264, 247, 248, 102/249, 251

[56] References Cited

U.S. PATENT DOCUMENTS

| | | | |
|---|---|---|---|
| 2,595,757 | 5/1952 | Brandt | 102/249 |
| 2,666,390 | 1/1954 | Brandt | 102/248 |
| 2,712,284 | 7/1955 | Thomas et al. | 102/248 |
| 2,778,310 | 1/1957 | Brandt | 102/248 |
| 3,139,828 | 7/1964 | Delaney et al. | 102/248 |
| 3,547,035 | 12/1970 | Brackman et al. | 102/248 |
| 3,890,901 | 6/1975 | Anderson et al. | 102/262 |
| 4,284,862 | 8/1981 | Overman et al. | 102/262 |
| 4,716,830 | 1/1988 | Davis et al. | 102/248 |

*Primary Examiner*—David H. Brown
*Attorney, Agent, or Firm*—Gerald K. White

[57] ABSTRACT

The device, in a first embodiment, has utility for operation on a dual pulse missile including a booster segment for launching and includes several main components, as follows: an inertial mass, a shaft with a zig zag channel, a gearless electric motor, a switch deck and blocking rotor, another blocking rotor, and a spring which provides a restoring force which acts against the inertia of the inertial mass. In a second embodiment, the device has utility for operation on a triple pulse missile including a booster segment for launching and includes several main components, as follows: two inertial masses, a shaft with a unique zig zag channel, two gearless electric motors, two switch decks with blocking rotors, two springs which provide restorative forces which act against the inertia of the inertia masses. In each of the embodiments, the blocking rotors have notches which interface with the associated inertial mass or masses and lock the rotors against rotative movement unless the inertial masses are in the proper positions.

10 Claims, 4 Drawing Sheets

MULTIPLE PULSE INERTIAL ARM/DISARM SWITCH

BACKGROUND OF THE INVENTION

1. Field of the Invention

The present invention relates to a multiple pulse inertial arming/disarming switch that is useful for providing a multiple pulse interlock between separate safety and arming devices that are used for each pulse in a multiple pulse missile system to prevent inadvertent arming/ignition of a second or successive pulse, the result of which would be catastrophic failure of the missile, until after a first or preceding pulse, respectively, has ended.

2. Description of the Prior Art

Various safety and arming devices have been proposed in the prior art for preventing accidental arming and premature ignition of ordnance devices. The ignition of flares or the explosion of bombs or missiles during handling, shipping or in storage creates a highly dangerous condition.

Percussion fuze devices have been proposed in which a fuze normally held inoperative by a safety device is released by setback forces developed upon launching of a projectile. Such a fuze is shown in U.S. Pat. No. 1,652,635 which was issued on Dec. 13, 1927 to B. Pantoflicek.

Another type of fuze device has been proposed wherein movement of a setback slide mechanism pivots a lever and initiates a timing mechanism to release a detonator carrier which is moved into an armed position. Such devices are shown in the following U.S. Pat. Nos.: 2,863,393, E. N. Sheeley; 3,139,828, J. Delaney, et al.; 3,724,385, B. D. Beatty, et al.; and 3,890,901, to M. E. Anderson, et al.

Still another type of fuze device has been proposed in which a slide mechanism, moving in a zig zag groove forming a race set into the body of the fuze, responds to setback forces developed during sustained acceleration of a projectile to arm the fuze. Devices of this type are disclosed in the following U.S. Pat. Nos.: 2,595,757, E. W. Brandt; 2,666,390, E. W. Brandt; and 4,716,830, to N. E. Davis, et al. U.S. Pat. No. 2,712,284 issued to H. E. Thomas, et al. on July 5, 1955 discloses the use of zig zag grooves for time delay purposes in fuzes.

While the safety and arming devices of the prior art exhibit a high degree of sophistication in their development and construction, they neither teach, nor suggest, a solution to the problem of providing an interlock system between safety and arming devices when, because of size limitations, two or three separate safety and arming devices are used in a dual pulse or triple pulse rocket motor instead of using a dual pulse or triple pulse safety and arming device, respectively, with a built-in interlock. Such an interlock system in each case, must be small and lightweight.

SUMMARY OF THE INVENTION

An object of the invention is to provide a unique multiple pulse inertial arm/disarm switch.

Another object of the invention is to provide such a switch having utility with dual pulse or triple pulse rocket motors using a booster motor.

A further object of the invention is to provide a small and lightweight interlock system for use between two or three safety and arming switches when two or three safety and arming switches are used in a dual pulse or triple pulse rocket motor, respectively.

In accomplishing these and other objectives of the invention, there is provided, in a first embodiment of the invention, a multiple pulse inertial arm/disarm switch having utility in a dual pulse solid propellant rocket motor which uses two separate safety and arming devices instead of a single pulse safety and arming device with a built-in interlock.

The purpose of the inertial arm/disarm switch is to prevent inadvertent arming/ignition of the second pulse (Pulse II) before or during the first pulse (Pulse I) motor firing. If Pulse II were ignited before Pulse I, the result would be catastrophic failure of the missile. The inertial arm/disarm switch is not a safety and arming device, but operates in a system where both Pulse I and Pulse II each have an individually associated safety and arming device. The inertial arm/disarm switch acts as an interlock, preventing the arming of the Pulse II safety and arming device until after Pulse I has ended.

In the first embodiment of the invention, the inertial arm/disarm switch has utility for operation on a two pulse missile with a booster segment used for launching. The switch has several main components including: an inertial mass, a unique zig zag channel or setback track, a gearless electric motor, a blocking rotor and switch deck, another blocking rotor, and a spring which provides a restoring force which acts against the inertia of the mass.

In a second embodiment, the invention comprises a triple pulse inertial arm/disarm switch. The switch has utility in a triple pulse motor with a booster motor that employs three separate safety and arming devices instead of a triple pulse safety and arming device with a built-in interlock.

The purpose of the inertial arm/disarm switch is to prevent inadvertent arming or ignition of the pulse motors before or during the burn of a prior pulse, that is, Pulse II should not be armed or ignited before or during the burn of Pulse I. If premature ignition occurs before or during a previous pulse, catastrophic failure of the missile would result. As in the first invention embodiment described, the inertial arm/disarm switch is not a safety and arming device. It operates as an interlock in a system where all three pulses have individually associated safety and arming devices. The inertial arm/disarm switch acts as an interlock between the several safety and arming devices, preventing the arming of the next pulse until after the burn of the prior pulse has ended.

The inertial arm/disarm switch of the second embodiment of the invention includes several main components, as follows: two inertial masses, a first shaft with a unique zig zag channel or setback track, two gearless electric motors, two switch decks with blocking rotors, two blocking rotors, a second shaft with a different zig zag channel or setback track, and two springs which provide restorative forces which act against the inertial masses. The blocking rotors have notches which interface with the inertial masses and lock the rotors unless the inertial masses are in the proper positions.

The various features of novelty which characterize the invention are pointed out with particularity in the claims annexed to and forming a part of the specification. For a better understanding of the invention, its operating advantages, and specific object attained by its use, reference is made to the accompanying drawings and descriptive matter in which a preferred embodiment of the invention is illustrated.

BRIEF DESCRIPTION OF THE DRAWINGS

With this description of the invention, a detailed description follows with reference being made to the accompanying figures of drawing which form part of the specification in which like parts are designated by the same reference numerals, and of which.

DESCRIPTION OF THE PREFERRED EMBODIMENT

Figure 2:
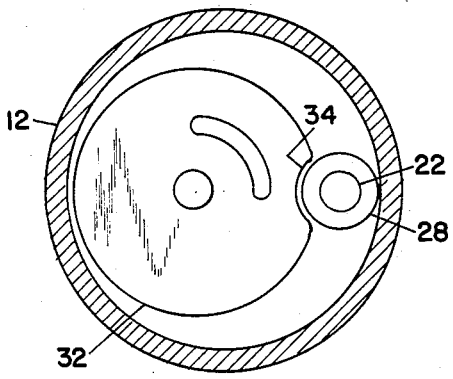
FIG. 2 is a sectional view taken along the lines 2—2 of FIG. 1.

In the first embodiment of the invention illustrated in FIGS. 1 through 9 of the drawings, there is provided a multiple pulse inertial arm/disarm switch having utility with dual pulse rocket motors using a booster motor, which switch is characterized by its small size and light weight. The switch is designated generally by the reference numeral 10 and includes an outer cylindrical enclosure or casing 12 which may be made of 4130 steel.

Figure 1:
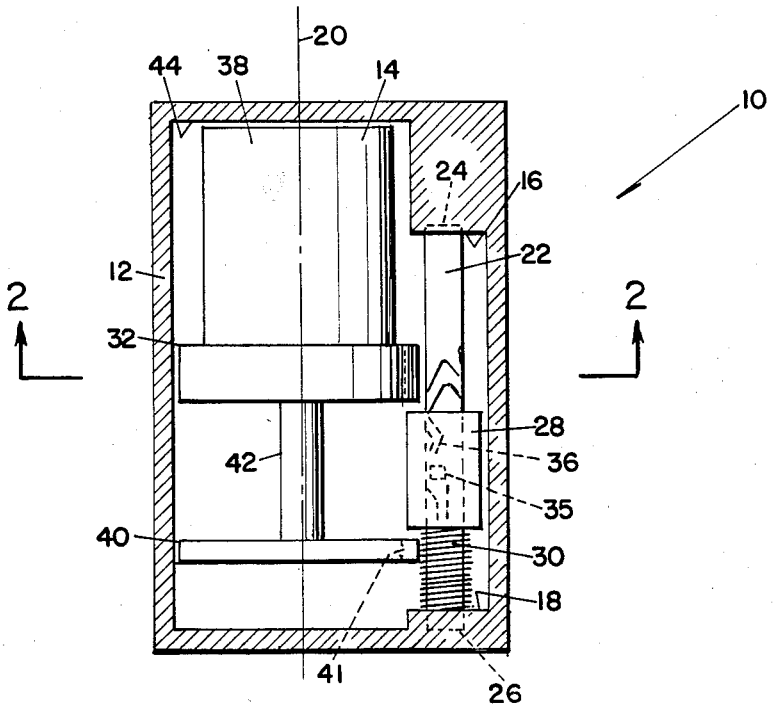
FIG. 1 is a sectional view of the casing or enclosure for the inertial multiple pulse arm/disarm switch according to the first mentioned embodiment of the invention, taken along the longitudinal axis thereof and without sectioning of the components contained therein.

Formed within a generally cylindrical chamber 14 within casing 12, at the upper and lower ends thereof, respectively, as seen in FIG. 1, are inwardly projecting shoulders 16 and 18. Rigidly supported between shoulders 16 and 18 and extending therebetween, in a direction parallel to a longitudinal axis 20 of casing 12, is an elongated shaft 22. The upper end of shaft 22 fits within a hole 24 in shoulder 16 and the lower end thereof fits within a hole 26 in shoulder 18.

Figure 9:
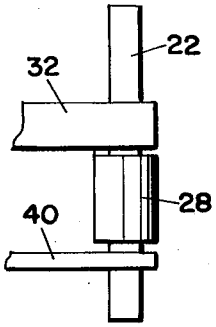
FIG. 9 is a schematic view illustrating the relationship of the inertial mass with respect to the blocking rotors after the Pulse I, acceleration phase, that is, with the Pulse II arming solenoid armed.

Surrounding shaft 22 in chamber 14 is a heavy walled sleeve inertial mass 28, which, for convenience, is referred to hereinafter as a first inertial mass means. Mass 28 is biased upwardly by a helical spring 30 and in FIG. 1, for convenience of illustration, is shown in the "ARMED" position, the position in which the mass 28 is also shown in FIG. 9 of the drawings.

Before any acceleration has occurred, the mass 28 is biased by spring 30 into engagement with the lower surface of the shoulder 16. One end of the spring 30 engages the mass 28 and the other engages the upper surface of the lower shoulder 18.

Figure 3:
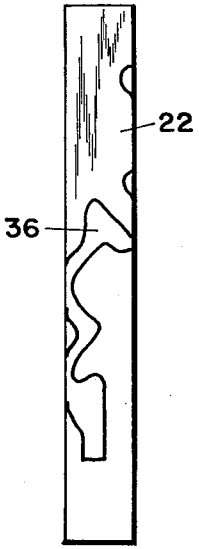
FIG. 3 is a view on an enlarged scale of the shaft of the inertial multiple pulse arm/disarm switch of FIGS. 1 and 2, on which shaft a setback track is formed.
Figure 4:
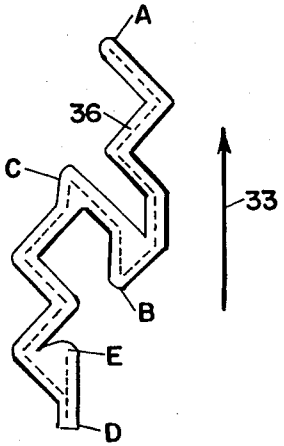
FIG. 4 is a plane development of the setback track on the shaft of FIGS. 1 and 3.

Mass 28 is adapted, as the result of setback forces developed during acceleration of the missile in which the switch 10 is installed, in the direction of the arrow 33, to move relatively to the shaft 22 against the force of the spring 30. Union between the masses 28 and the shaft 22 is effected during such movement by a slide pin 35 carried by mass 28, which pin 35 is adapted to run along a longitudinally disposed zig zag channel or setback track 36, as best seen in FIGS. 3 and 4, that is provided on the periphery of shaft 22. The zig zag channel 36 causes the longitudinal movement of the mass 28 along the shaft 22 to include an oscillatory rotative component.

Also contained within the casing 12 is a gearless electric motor 38, a blocking rotor and switch deck 32, and another blocking rotor 40. The blocking rotors 32 and 40 are attached to and adapted to be rotated by a rotatable elongated shaft 42 that, in turn, is adapted to be rotated by motor 36 which is attached to one end thereof. For convenience, shaft 42 is referred to hereinafter as a second shaft. Rotatable shaft 42, as best seen in FIG. 1, extends in chamber 14 parallel to but spaced from the fixed shaft 22. A first end of the shaft 42 is attached to the motor 38 with a second end thereof remote from motor 38.

The blocking rotor 40 is spaced a distance from the blocking rotor 32 that is slightly greater than the length of the inertial mass 28, as shown in the drawings. The motor 38 is suitably attached at the end thereof remote from the blocking rotors 32 and 40 to the upper and inner end wall 44 of the casing 12.

The blocking rotors 32 and 40 have arcuate notches 34 and 41, respectively, in the edges thereof which interface with the inertial mass 28 and lock the rotors unless the inertial mass 28 is in the proper position, as shown in FIG. 1.

Figure 5:
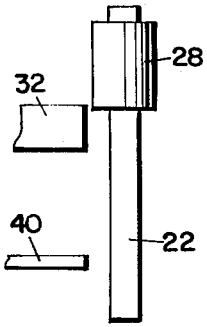
FIG. 5 is a schematic view illustrating the relationship of the inertial mass of the inertial arm/disarm switch of FIG. 1 with respect to the blocking rotors during the fully safe condition.

In the operation of the multiple pulse inertial arm/disarm switch 10, before any acceleration has occurred, the inertial mass 28 is held at the top of the channel or setback track 36 by the spring 30 on the shaft 22 at position A, as seen in FIG. 4. In this position of the mass 28, the rotor and switch deck 32 and the rotor 40 are blocked and cannot rotate, as shown in FIG. 5. The multiple pulse inertial arm/disarm switch 10 is then in the fully safe condition thereof.

Figure 7:
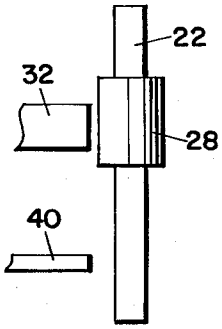
Figure 6:
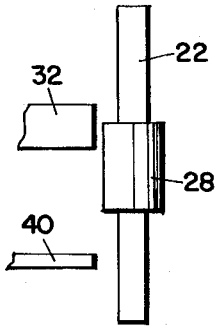

During booster acceleration, the mass 28 is pulled down to position B, as indicated in FIG. 4. In this position of the mass 28, as indicated in FIG. 6, the blocking rotor and switch deck 32 is still blocked. When the booster acceleration has ceased, the spring 30 pushes the mass 28 upwards to position C, as shown in FIG. 4, the channel 36 being so configured as to effect a reversal in the direction thereof at position B relatively to shaft 22. The blocking rotor and switch deck 32 is still blocked in position C of the mass 28, as indicated in FIG. 7.

Figure 8:
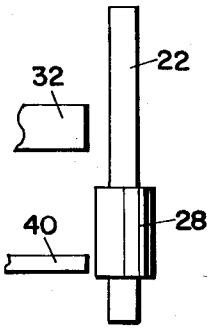
FIGS. 6, 7 and 8 are schematic views illustrating the relationship of the inertial mass with respect to the blocking rotors during the booster acceleration phase of the missile, after boost, and during the Pulse I acceleration phase, respectively.

During Pulse I acceleration, the mass 28 is pulled down to position D, in which position the direction of channel 36 relatively to shaft 22 is again reversed, as shown in FIG. 4. In position D of the mass 28, as seen in FIG. 8, the blocking rotor 40 is blocked thereby. Only after Pulse I acceleration has ended, and the mass 28 has been pushed by spring 30 up to position E, as seen in FIG. 4, are the blocking rotor and switch deck 32 and the blocking rotor 40 free to rotate upon command.

It is noted that the zig zags in the channel 36 cooperate with the spring 30 to prevent the inertial mass 28 from moving the full distance between positions A and B and between positions C and D when the multiple pulse inertial arm/disarm switch is subjected to sharp shock. Such movement is allowed, however, as described above, in response to sustained acceleration.

When it is time to arm the Pulse II safety and arm device, the motor 38 is commanded to rotate thus rotating blocking rotor and switch deck 32 and the blocking rotor 40, and completing the circuit (not shown) of the switch deck for the Pulse II safety and arming device. The Pulse II safety and arming device will then arm and fire upon command.

Details of the construction of the switch deck of the blocking rotor and switch deck 32 and the related circuitry are not given herein since they form no part of the present invention.

In accordance with the invention, the motor used in the multiple pulse inertial arm/disarm switch 10 has sufficient torque when stalled to eliminate the need for gearing and speed reduction. By way of example but not limitation, it is noted that the motor 38 may be an INLAND QT-0214 D.C. MOTOR providing 20 OZ. IN. TORQUE AT 132 WATTS.

The second embodiment of the invention illustrated in FIGS. 10 through 18 of the drawings comprises a multiple pulse inertial arm/disarm switch which is designated by reference numeral 46 and is contained within an enclosure or casing 48 having an irregular outline. Switch 46, similarly to switch 10 of the first invention embodiment, is also characterized by its small size and light weight. Casing 48 may also be made of 4130 steel.

Figure 10:
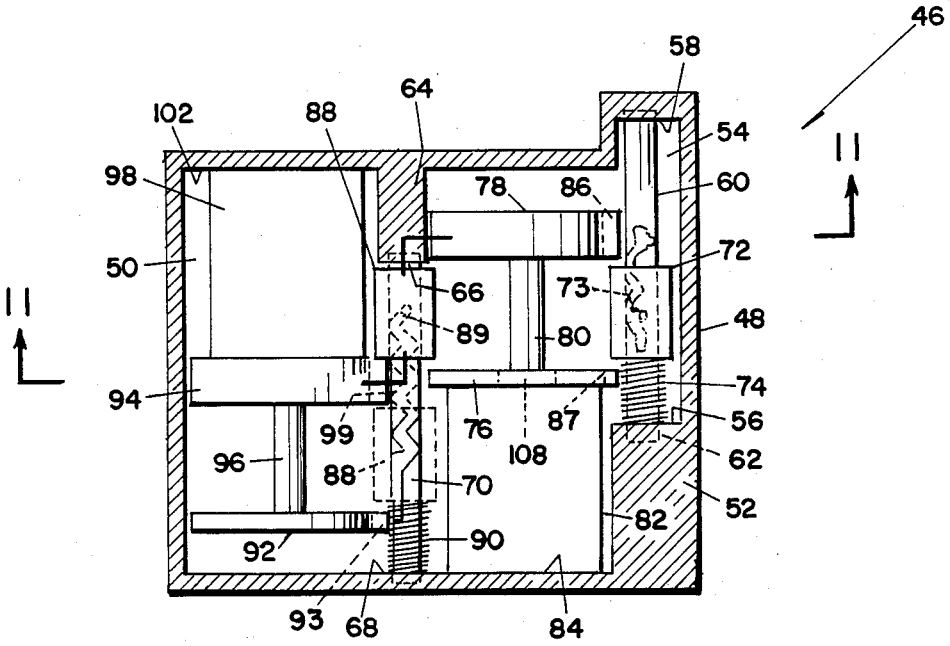
FIG. 10 is a sectional view of the casing or enclosure for the inertial multiple pulse arm/disarm switch according to the second embodiment of the invention, taken along the longitudinal axis thereof and without sectioning of the components contained therein.

Formed in a chamber 50 within the casing 48, at the bottom at one end thereof, as seen in FIG. 10, is an inwardly projecting shoulder 52. In the upper wall of the casing 48, immediately above the shoulder 52, is an upwardly extending portion or recess 54. Rigidly supported between the upper surface 56 of shoulder 52 and the upper inner wall surface 58 of wall portion 54 is a first shaft 60, with the lower end of the shaft 60 extending into a hole 62 in the shoulder 52.

Also formed within the chamber 50 at an intermediate position at the top thereof is an inwardly and downwardly projecting shoulder 64. Rigidly supported between the bottom surface 66 of shoulder 64 and the lower inner surface wall 68 of the casing 48 is a second shaft 70.

Figure 11:
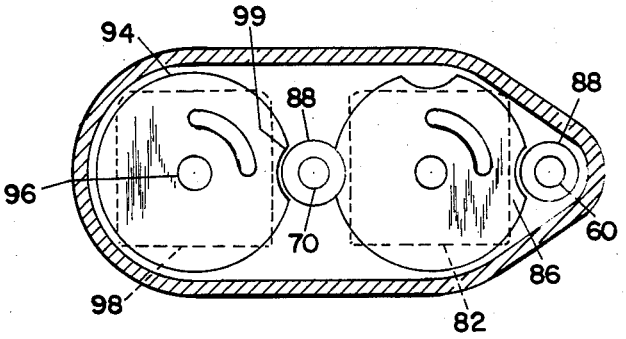
FIG. 11 is a sectional view taken along the lines 11—11 of FIG. 10.

Surrounding shaft 60 in the chamber 50 is a heavy walled sleeve inertial mass 72, which, for convenience, is referred to hereinafter as a first inertial mass means. Mass means 72 is biased upwardly by a helical spring 74. Also contained within the casing 48 and positioned in operative association with the inertial mass means 72 are a blocking rotor 76 and a blocking rotor and switch deck 78, which are attached, in suitably spaced relation, to a shaft 80. Shaft 80, in turn, is attached to and adapted to be rotated by a gearless electric motor 82. Motor 82 is suitably attached at the lower end thereof, as shown in FIG. 10, to the lower inner end wall 84 of the enclosure 48. Blocking rotor 76 has an arcuate notch 86 on the edge thereof, as best seen in FIG. 11, and is positioned on a first end of the shaft 80 adjacent the upper end of motor 82. Blocking rotor and switch deck 78 is positioned on the second end of the end of the shaft 80 remote from the motor 82.

Surrounding the shaft 70 in chamber 50 in the casing 50 is a heavy walled sleeve inertial mass 88 which, for convenience, is hereinafter referred to as a second inertial mass means. Mass means 88 is biased upwardly by by a helical spring 90. Mass means 88, as best seen in FIGS. 10 and 11, is positioned in operative relation with the previously mentioned blocking rotor 76 and the blocking rotor and switch deck 78 and also with an oppositely positioned blocking rotor 92 and a blocking rotor and switch deck 94. Blocking rotor 92 and blocking rotor and switch deck 94 are carried on a shaft 96, being rigidly attached thereto. Shaft 96 is attached at a first end to a gearless electric motor 98 for rotation thereby. The motor 98 is suitably attached at the upper end thereof to an upper inner wall surface 102 of the enclosure 48. The blocking rotor 92 is positioned on the second end of shaft 96 remote from the motor 98. The blocking rotor and switch deck 94 is positioned on the shaft 96 adjacent the motor 98, and as best seen in FIG. 11, has an arcuate notch 99.

In accordance with the invention, as best seen in FIG. 11, the four shafts 60, 70, 80 and 96 desirably may be positioned on the same straight line.

Figure 12:
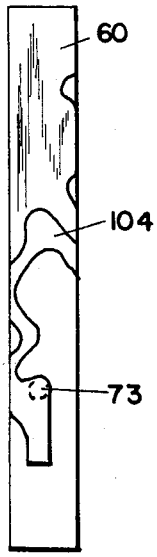
FIG. 12 is a view on an enlarged scale of a first shaft of the inertial multiple pulse arm/disarm switch on which, as shown, a setback track is formed.
Figure 13:
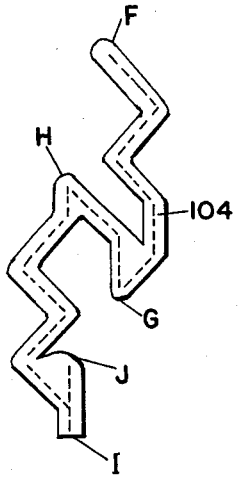
FIG. 13 is a plane development of the setback track on the first shaft of the switch of FIG. 10.
Figure 14:
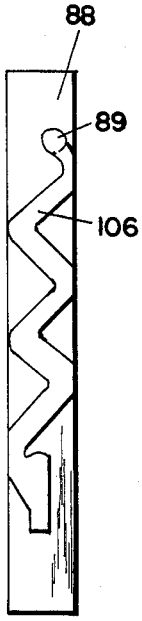
FIG. 14 is a view on an enlarged scale of a second shaft of the inertial multiple pulse arm/disarm switch on which a setback track is formed.
Figure 15:
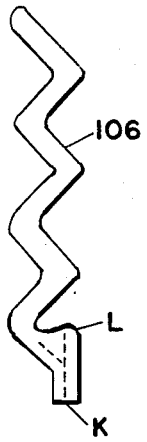
FIG. 15 is a plane development of the setback track formed on the second shaft of the switch of FIG. 10.
Figure 16:
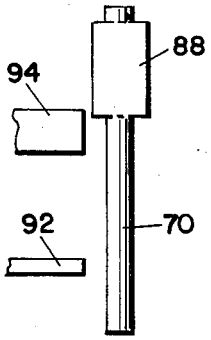
FIG. 16 is a schematic view illustrating the relationship of the inertial masses of the inertial arm/disarm switch of FIG. 10 with respect to the blocking rotors with the Pulse II arming solenoid disarmed.

Union between the inertial mass 72 and the shaft 60 is effected during movement of the mass 72 thereon by a slide pin 73 carried by mass 72. The slide pin 73 is adapted to run along a longitudinally disposed zig zag channel or setback track 104 that is provided on the periphery of shaft 60, as illustrated in FIGS. 12 and 13.

Similarly, union between the inertial mass 88 and the shaft 80 is effected during movement of the mass 88 thereon by a slide pin 89 carried by the mass 88. The slide pin is adapted to run along a longitudinally disposed zig zag channel or setback track 106 that is provided on the periphery of shaft 80.

The blocking rotor 76 and the blocking rotor and switch deck 78 have arcuate notches 86 and 87, respectively, in the edges thereof which interface with the inertial mass 72 and lock the rotors 76 and 78 unless the inertial mass is in the proper position, as shown in FIG. 10.

Similarly, the blocking rotor 92 and blocking rotor and switch deck 94 have arcuate notches 93 and 99, respectively, in the edges thereof which interface with the inertial mass 88 and lock the rotors 92 and 94 in place unless the inertial mass 88 is in the proper position, as shown in dotted lines in FIG. 10.

In the operation of the multiple pulse, inertial arm/disarm switch 46, before any acceleration has occurred, the inertial mass 72 is held at the top of the setback track on shaft 60 by the spring 74 at position F, as indicated in FIG. 13. The blocking rotor 76 and blocking rotor and switch deck 78 are blocked and cannot rotate unless the inertial mass 72 is in the correct position shown in FIGS. 10 and 17.

During booster acceleration, the mass 72 is pulled down to position G as indicated in FIG. 13. When the booster acceleration has ceased, the spring 74 pushes the mass 72 to position H. The blocking rotor is still blocked with the mass 72 in this position.

During Pulse I acceleration, the mass 72 is pulled down to position I, as seen in FIG. 13, blocking the rotor 76. Only after Pulse I acceleration has ended, and the mass 72 has been pushed up by the spring 74 to position J are the blocking rotor 76 and the blocking rotor and switch deck 78 free to rotate upon command.

When it is time to arm the Pulse II safety and arm device, the motor 82 is commanded to rotate, thus effecting rotation of the blocking rotor and switch deck 78 and the blocking rotor 76 and completing the arming circuit in the switch deck 78 for the Pulse II safety and arm device. The Pulse II safety and arm device will now arm and fire upon command.

The rotation of the blocking rotor 76 also moves an arcuate notch 108 in the edge thereof into a position which allows the second inertial mass 88 to move on the shaft 96 in response to acceleration of the missile. This second inertial mass 88 is restrained from moving during the booster and Pulse I acceleration by the blocking rotor 72. When the mass 88 is in this position, the blocking rotor 92 and the blocking rotor and switch deck 94 are restrained from rotating by the notch 99 in the blocking rotor and switch deck 94, which notch 99 is captured by the inertial mass 88.

Figure 17:
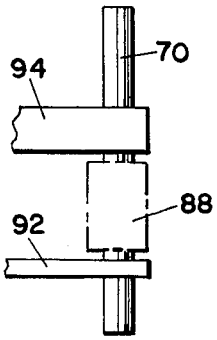
FIG. 17 is a schematic view illustrating the relationship of the inertial masses with respect to the blocking rotors after the Pulse I acceleration phase, that is, with the Pulse II arming solenoid armed.

During Pulse II acceleration, the inertial mass 88 is pulled down, overcoming the force exerted by spring 90. When the mass 88 reaches the bottom position K of the zig zag setback track on the shaft 70, it is trapped by a zig zag on the shaft 70, and cannot rise again. With the inertial mass 88 in this trapped position, indicated by the letter L in FIG. 14, the blocking rotor 92 and the blocking rotor and switch deck 94 are free to rotate upon command, as illustrated in FIG. 17.

When it is time to arm the Pulse II safety and arm device, the motor 98 is commanded to rotate, thus effecting rotation of the blocking rotor 92 and the blocking rotor and switch deck 94 and completing the arming circuit for the Pulse III safety and arm device. The Pulse III safety and arming device will now arm and fire upon command.

As in the first embodiment of the invention, the electric motors 82 and 98 may comprise an Inland QT-0214 D.C. motor providing 20 oz. in torque at 132 watts and have enough torque when stalled to eliminate the need for gearing and speed reduction.

Thus, in accordance with the invention there has been provided a multiple pulse inertial arm/disarm switch, which switch in a first embodiment has particular utility with dual pulse rocket motors using a booster motor, and in a second embodiment has particular utility with triple pulse rocket motors using a booster motor. The invention is characterized in its provision of a small and lightweight interlock system, for use, in the first embodiment described, between two safety and arm devices used in a dual pulse rocket motor, and for use in the second mentioned embodiment between three safety and arm devices used in a triple pulse and rocket motor.

With this description of the invention in detail, those skilled in the art will appreciate that modifications may be made to the invention without departing from the spirit thereof. Therefore, it is not intended that the scope of the invention be limited to the specific embodiments illustrated and described. Rather, it is intended that the scope of the invention be determined by the scope of the appended claims.

What is claimed is:

1. A multiple pulse inertial arm/disarm switch for providing an interlock between separate safety and arming devices used in a multiple pulse missile system to prevent inadvertent arming/disarming ignition of a second or successive pulse until after a first or preceding pulse has ended, comprising:

a casing forming a chamber having a first end and a second end, first shaft means rigidly supported between the first end and the second end of said chamber, said first shaft means having a channel of zig zag shape formed along the length of said first shaft means on the periphery thereof, with said channel reversing directions relatively to said first shaft means at each of first and second positions spaced longitudinally thereof, first inertial mass means positioned to slide on said first shaft means, means carried by said first inertial mass means and disposed in cooperative relationship with the channel on said first shaft means for guiding the sliding movement of said first inertial mass means along said first shaft means, first spring means positioned at the second end of said chamber and biasing said first inertial mass means toward the first end of said chamber, the zig zags in the shape of the channel of said first shaft means cooperating with said first spring means to preclude said inertial mass means from moving the full distance between the positions along the length of said first shaft means at which the direction of the channel, longitudinally of said first shaft means, is reversed when the multiple pulse inertial arm/disarm switch is subjected to sharp shock but allowing said first inertial mass means to move such full distance between such positions in response to sustained acceleration thereof, first motor means supported at said first end of said chamber, second shaft means having a first end and a second end and extending in said chamber substantially parallel to but spaced from said first shaft means, one of the ends of said second shaft means being attached to said motor means for rotation of said second shaft means by said first motor means, a first blocking rotor positioned on said second shaft means, said blocking rotor having an edge with a notch therein that is so positioned in cooperative relationship with the periphery of said first inertial mass means as to preclude rotation of said first blocking rotor by said first motor means when said first inertial mass means is positioned adjacent one of the first and second ends of said chamber, and a first blocking rotor and switch deck positioned on said second shaft in spaced relation with respect to said first blocking rotor, said first blocking rotor and switch deck having an edge with a notch therein that is so positioned in cooperative relationship with the periphery of said first inertial mass means as to preclude rotation of said first blocking rotor and switch deck when said first inertial mass means is positioned adjacent the other one of said first and second ends of said chamber, the spacing of the first and second shafts and said first blocking rotor and said first blocking rotor and switch deck being such that, in all but a predetermined range of positions of said first inertial mass means on said first shaft means, either said first blocking rotor or said first blocking rotor and switch deck is precluded from rotation by said first motor means.

2. A multiple pulse inertial arm/disarm switch as defined by claim 1 wherein the first end of said second shaft means is attached to said motor means and said first blocking rotor is positioned thereon adjacent the second end thereof.

3. A multiple pulse inertial arm/disarm switch as defined by claim 1 wherein the second end of said second shaft means is attached to said motor means and the said first blocking rotor and switch deck is positioned thereon adjacent the first end thereof.

4. A multiple pulse inertial arm/disarm switch as defined by claim 1 wherein said means carried by said first inertial mass means for guiding the sliding movement thereof along said first shaft means comprises a slide pin.

5. A multiple pulse inertial arm/disarm switch as defined by claim 1 wherein said casing includes a first shoulder formed in the first end of said chamber and a second shoulder formed in the second end thereof, said first shaft means being supported between said shoulders.

6. A multiple pulse inertial arm/disarm switch as defined by claim 5 wherein said casing is substantially cylindrical in form.

7. A multiple pulse inertial arm/disarm switch as defined by claim 1 further including:

third shaft means rigidly supported between the first end and the second end of said chamber with the spacing of said third shaft means and said first shaft means from said second shaft means being substantially the same, said third shaft means having a channel of zig zag shape formed along the length thereof, second inertial mass means positioned to slide on said third shaft means, means carried by said second inertial mass means and disposed in cooperative relationship with the channel on said third shaft means for guiding the sliding movement of said second inertial mass means along said third shaft means, second spring means positioned at the second end of said chamber and biasing said second inertial mass means toward the first end of said chamber, the zig zags in the shape of the channel of said third shaft means cooperating with said second spring means to preclude said second inertial mass means moving the full distance along the length thereof, when the multiple pulse inertial arm/disarm switch is subjected to sharp shock but allowing said second inertial mass means to move such full distance between such positions in response to sustained acceleration thereof, second motor means supported at said second end of said chamber, fourth shaft means having a first end and a second end and extending in said chamber substantially parallel to but spaced from said third shaft means, one of the ends of said fourth shaft means being attached to said second motor means for rotation of said second shaft means by said second motor means, a second blocking rotor positioned on said fourth shaft means, said second blocking rotor having an edge with a notch therein that is so positioned in cooperative relationship with the periphery of said second inertial mass means as to preclude rotations of said second blocking rotor by said second motor means when said second inertial mass means is positioned adjacent one of the first and second ends of said chamber, and a second blocking rotor and switch deck positioned on said fourth shaft means in spaced relation with respect to said second blocking rotor, said second blocking rotor and switch deck having an edge with a notch therein that is so positioned in cooperative relationship with the periphery of said second inertial mass as to preclude rotation of said second blocking rotor and switch deck when said second inertial mass means is positioned adjacent the other one of said first and second ends of said chambers, the spacing of the third and fourth shafts and said second blocking rotor and said second blocking rotor and switch deck being such that, in all but a predetermined range of positions of said second inertial mass means on said first shaft means either said second blocking rotor or said second blocking rotor and switch deck is precluded from rotation by said second motor means.

8. A multiple pulse inertial arm/disarm switch as defined by claim 7 wherein said first, second, third and fourth shaft means are all positioned on the same straight line.

9. A multiple pulse inertial arm/disarm switch as defined by claim 7 wherein the second end of said second shaft means is attached to said first motor means and said first blocking rotor is positioned thereon adjacent the first end thereof, and wherein the first end of said fourth shaft means is attached to said second motor means and said second blocking rotor is positioned thereon adjacent the second end thereof.

10. A multiple pulse inertial arm/disarm switch as defined by claim 9 wherein said casing includes a first shoulder in said chamber at the first end of said casing and a recess at the second end of said chamber with said first shaft means having one end supported by said shoulder and the other end extending into said recess, and wherein said casing further includes a second shoulder in said chamber at the second end thereof with said third shaft means between said shoulder and the first end of said chamber.

* * * * *